US005865682A

United States Patent [19]

Sutton

[11] Patent Number: 5,865,682

[45] Date of Patent: Feb. 2, 1999

[54] CUE TIP CONDITIONING DEVICE

[76] Inventor: Justin E. Sutton, 3280 Chilson, Howell, Mich. 48843

[21] Appl. No.: 953,673

[22] Filed: Oct. 17, 1997

[51] Int. Cl.[6] ..... A63D 15/16

[52] U.S. Cl. ..... 473/37

[58] Field of Search ..... 473/35, 36, 37, 473/38, 39

[56] References Cited

U.S. PATENT DOCUMENTS

| | | | |
|---|---|---|---|
| 798,914 | 9/1905 | Michaelson | 473/37 |
| 1,273,219 | 7/1918 | Hall | 473/37 |
| 1,571,211 | 2/1926 | Nelson | 473/37 |
| 3,131,933 | 5/1964 | Rodrigue | 473/37 |
| 3,781,008 | 12/1973 | Espinoza | 473/37 |
| 3,894,735 | 7/1975 | Dickens | 473/37 |
| 3,963,237 | 6/1976 | Bushberger | 473/37 |

*Primary Examiner*—Theatrice Brown
*Attorney, Agent, or Firm*—Charles W. Chandler

[57] ABSTRACT

A device for conditioning the tip of a pool cue includes a hand-held housing containing a motor and two or more separate tip conditioning mechanisms separately powered by the motor. The pool cue can be inserted into one opening in the housing for subjecting the cue tip to a scuffing action. The pool cue can be inserted into a second opening in the housing in order to apply chalk to the cue tip surface. Preferably the housing contains a powder dispenser for supplying moisture-absorbing powder to the hands of the pool player.

19 Claims, 1 Drawing Sheet

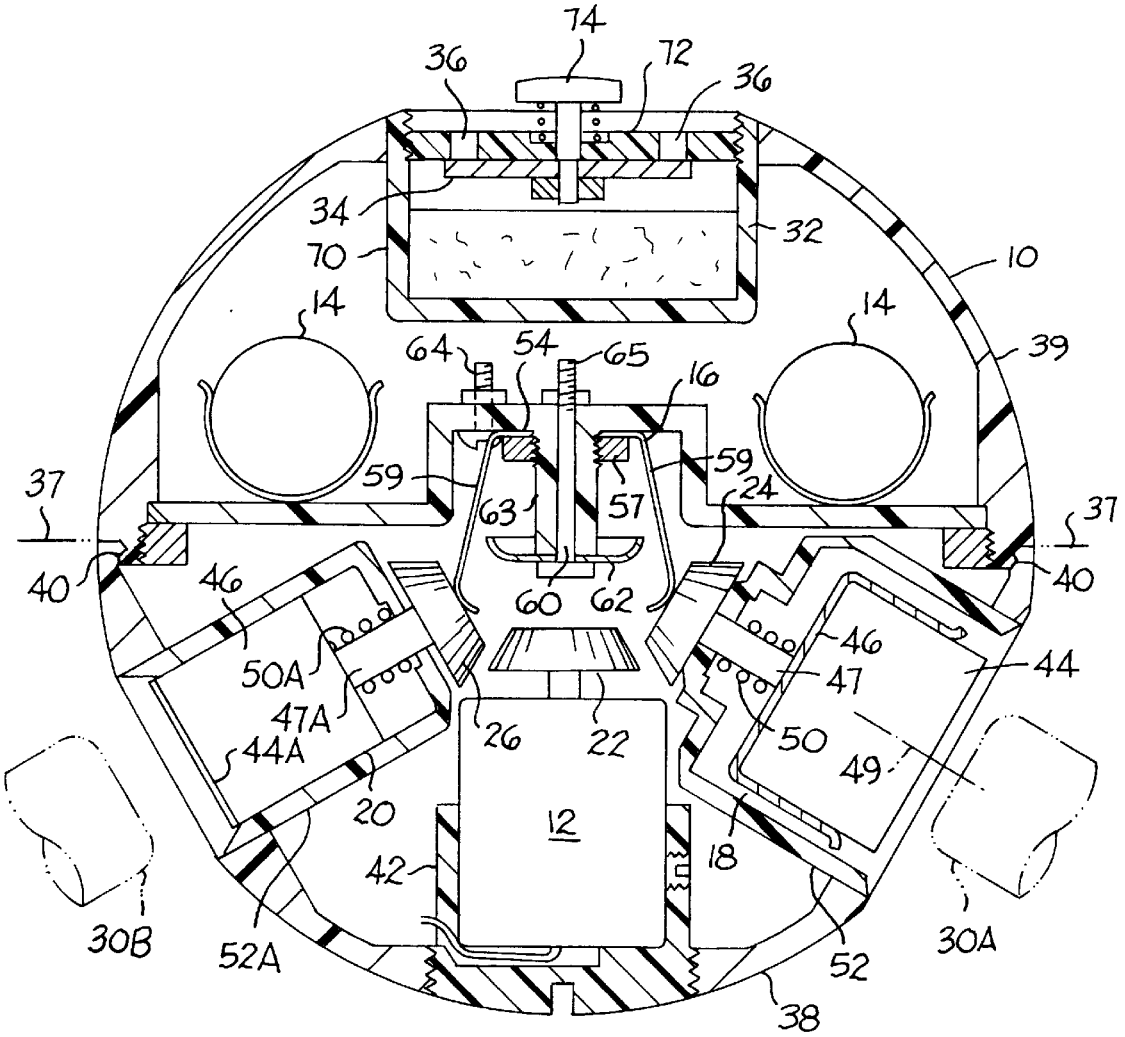
74
36
72
36
34
32
70
10
14
14
39
64
54
65
16
59
59
37
63
57
24
37
40
40
46
60
62
46
50A
47
44
47A
26
22
50
44A
49
20
12
18
42
30B
52A
52
30A
38

CUE TIP CONDITIONING DEVICE

BACKGROUND AND SUMMARY OF THE INVENTION

This invention relates to a device for conditioning (or reconditioning) the tip of a pool cue. The conditioning activity can involve scuffing or grinding the cue tip, or adding chalk to the cue tip. The conditioning device is a portable hand-held implement having an internal battery-powered motor and several separate rotary tip conditioning mechanisms selectively connectable to the motor when contacting the tip of a pool cue.

The concept of mechanically adding chalk to the tip of a pool cue is known in the prior art. U.S. Pat. No. 798,914 issued to C. Michaelson on Sep. 5, 1905, shows a chalking device that includes a chalk holder attached to the drive shaft of an electric motor. When the motor is energized and a pool cue is inserted into the device, the rotating block of chalk rubs against the cue tip surface to rechalk the tip.

U.S. Pat. No. 3,781,008, issued to C. Espinoza on Dec. 25, 1973 introduces a timing feature to the mechanical chalking apparatus. A timing mechanism de-energizes the motor after a predetermined time, typically ten seconds. The object is to avoid unnecessary energization of the motor and chalk waste caused by prolonged insertion of the pool cue into the chalking device.

U.S. Pat. No. 3,894,735, to R. Dickens discloses a chalking apparatus wherein the chalk holder is slidable on the motor shaft so as to engage a motor control switch when a pool cue is inserted into the apparatus. The motor is energized only when a pool cue contacts the chalk.

The present invention relates to a hand-held implement having a spherical housing, an electric motor within the housing, at least two separate cue tip conditioning mechanisms within the housing, and clutch means for selectively transmitting a drive force from the motor to either tip conditioning mechanism when a cue tip is brought into pressure contact with the respective conditioning mechanism.

One of the tip conditioning mechanisms includes means for scuffing or abrading the surface of the cue tip. Another tip conditioning mechanism includes a block of chalk for adding chalk to the cue tip surface. Depending on the apparatus construction, up to four separate tip conditioning mechanisms can be incorporated into the housing.

In the preferred practice of the invention, a powder dispenser is included in the housing. Persons playing pool or billiards can recondition the pool cue tips and at the same time add moisture-absorbing powder to their hands, using a single apparatus.

Further features of the invention will be apparent from the attached drawing and description of an illustrative embodiment of the invention.

DESCRIPTION OF THE DRAWING

The single FIGURE is a sectional view taken through a device constructed according to the invention.

DESCRIPTION OF A PREFERRED EMBODIMENT OF THE INVENTION

The drawing shows a pool cue tip conditioning device that includes a spherical housing 10 containing a D.C. motor 12, batteries 14 for powering the motor, a motor control switch means 16, a first cue tip conditioning mechanism 18, and a second cue tip conditioning mechanism 20, and clutch elements 22, 24, and 26 carried by the motor drive shaft and conditioning mechanisms, whereby the tip conditioning mechanisms are selectively driven by the motor in response to pressure exerted thereon by the cue tip. A cue tip 30A or 30B is shown in dashed lines in two alternate positions prior to insertion into the device. As shown at 30A, the cue tip is aligned with a chalk-applying mechanism 18 in housing 10. As shown at 30B, the cue tip is aligned with a cue tip scuffing mechanism 20 in housing 10. When the cue tip is advanced into housing 10, the respective tip conditioning mechanism 18 or 20 is rotated by motor 12 to produce the desired tip conditioning action. Electric switch 16 turns the motor on or off in response to insertion or withdrawal of the cue.

As an additional feature of the invention, a powder dispenser 32 is built into housing 10. The dispenser includes a disc-like valve 34 that may be manually depressed to allow powder to be gravitationally dispensed through dispenser openings 36 when the housing is turned over (from the position shown in the drawing). The powder is commonly used by pool players to remove moisture from the player's hands, and to promote a sliding action between the hand and the cue stick.

Referring in greater detail to housing 10, the hollow spherical structure is split on a diametrical plane 37 into two separable semi-spherical housing sections 38 and 39. These sections are joined together by an annular yieldable tongue and groove connection 40, whereby the housing sections are normally joined together as shown. However, the housing sections can be pried apart when it becomes necessary to gain access to the housing interior space, e.g. to replace the batteries.

Spherical housing 10 can be made in a range of sizes. However, typically the housing will have an outside diameter of about 3", i.e. small enough to be held in a person's hand, but large enough to contain the motor, batteries and other mechanisms. The exterior surface of the spherical housing can have any coloration. Preferably the housing surface will be colored black, with the number eight printed thereon, whereby the housing resembles the eight ball used in the game of pool. The spherical housing will be distinguishable because it will ordinarily be somewhat larger than a conventional pool ball. The diameter of a pool ball is about 2¼", whereas the diameter of spherical housing 10 may be about 3".

Electric motor 12 is suitably mounted in a cage 42 that is threaded or otherwise configured for fixed disposition within housing section 38. The drive shaft of the motor carries a bevel gear 22 that serves as a clutch element for transferring power from the motor to either the tip conditioning mechanism 18 or tip conditioning mechanism 20.

Cue tip conditioning mechanism 18 comprises a block of chalk 44 removably disposed in a carrier 46 that is attached to a shaft 47, whereby the carrier is rotatable around shaft axis 49. A coil spring 50 normally biases the carrier downwardly to its illustrated position in tubular support structure 52. Shaft 47 carries a bevel gear 24 that serves as a clutch or transmission element for transferring rotary power from clutch element 22 to carrier 46.

Other types of clutch elements could be used such as a rubberized surface.

Motor control switch 16 comprises a thin electrically-conductive plate 54 secured to partition 56 by means of any suitable fastener such as a threaded nut 57. Plate 54 has plural electrically-conductive leaf arms 59 extending into the path of each cue tip conditioning mechanism 18, 20, etc., whereby movement of a given mechanism toward the housing sphere axis 60 deflects the respective leaf arm into contact with a conductive disk 62 mounted on center stem 63.

Switch 16 has one terminal 64 connected to conductive plate 54 and another terminal 65 connected to disk 62. Lead wiring can be used to connect the switch to motor 12 and battery pack 14. Bevel gears 22, 24 and 26 may be formed of plastic so as not to interfere with the electrical switch action.

In operation of apparatus, the pool cue can be moved from position 30A into contact with chalk 44, thereby deflecting mechanism 18 toward central axis 60. During engagement of gear 22 with gear 24, the rightmost switch 16 metal leaf arm 59 closes against metal disk 62, whereby motor 12 is energized to rotate bevel gear 24. Gear 24 is rotating slowly when gear 22 begins to mesh with the teeth of gear 24. As gear 22 comes into full mesh with gear 24, leaf arm 59 may bend slightly while remaining in contact with disk 62.

Both leaf arm 59 and disk 62 are made of single piece stampings that include a center star-shaped opening that provides for one way application to center stem 63. The points of the star dig into the center stem to prevent the leaf arms from sliding off the stem.

Mechanism 18 continues to rotate as long as the cue is held in pressure contact with chalk 44. When the cue is withdrawn spring 50 returns carrier 46 (and the chalk) to the illustrated position. Leaf arm 59 separates from disk 62, thereby de-energizing motor 12.

Tip conditioning mechanism 20 is in many respects similar to mechanism 18, except for the tip conditioning action. Mechanism 20 comprises a cylindrical carrier 46 having a support shaft 47A rotatably mounted in a tubular support structure 52A. A spring 50A normally biases the carrier to its illustrated position.

The end face of carrier 46 has a circular sand paper patch 44A attached by a suitable epoxy adhesive. When carrier 46 is rotated (by motor 12) the sand paper scuffs the surface of the cue tip. Carrier 46 could also be provided with a wire brush or knurled metal surface as a conditioning element.

In operation, tip conditioning mechanism 20 is energized by inserting the pool cue from position 30B into pressure contact with abrasive surface 44A, whereby carrier 46A is moved toward central axis 60. The associated switch leaf arm 59 is brought into contact with disk 62, such that switch 16 energizes motor 12. Rotary power is transferred from the motor to carrier 46 via clutch elements 22 and 26.

The drawings show two tip conditioning mechanisms 18 and 20. However, there is space in the housing available for three or four mechanisms. When four mechanisms are employed, the two non-illustrated mechanisms would be located behind and in front of the plane of the paper. When three mechanisms are employed, the mechanisms would preferably be spaced equidistantly apart, i.e. about 120° in the plainer dimension about the vertical axis.

The various tip conditioning mechanisms could perform slightly different functions on the cue tip. For example, different sand paper abrasive properties (fine or coarse) can be used in different conditioning mechanisms. Preferably the motor and tip conditioning mechanisms are housed in one of the sphere half sections, while powder dispenser 32 is located in the other sphere half section.

The powder dispenser comprises a cup-shaped container 70 having a closure wall 72 equipped with powder discharge openings 36. When housing 10 is turned over, a plunger 74 can be manually depressed to cause valve disk 34 to uncover openings 36, thereby allowing gravitational discharge of the powder.

Openings 36 can also be left open and the powder removed as in using a salt shaker.

The drawings necessarily show a specific form of the invention. However, it will be appreciated that the invention can be embodied in various forms and arrangements.

Each conditioning mechanism could incorporate a timed release feature of the type disclosed in U.S. Pat. No. 3,781,008.

Having described my invention, I claim:

1. A device for conditioning a cue tip, comprising:

a housing;

an electric motor within said housing;

said motor having a drive shaft and a first clutch element on said shaft;

a tip conditioning mechanism rotatably mounted in said housing;

a second clutch element on said conditioning member;

spring means biasing said conditioning mechanism away from a position wherein said second clutch element is engaged with said first clutch element; and said conditioning mechanism being deflectable to a clutch-engaged position by contact with a cue tip.

2. The device of claim 1, and further comprising a powder dispenser within said housing.

3. The device of claim 2, wherein said powder dispenser comprises a closure wall having a plurality of powder discharge openings and a manually depressible valve means controlling powder flow through said openings.

4. The device of claim 2, wherein said housing is a hollow sphere split on a diametrical plane into two separable semi-spherical housing sections;

said motor and said tip conditioning mechanism being located in one of said housing sections; and said powder dispenser being located in the other housing section.

5. The device of claim 4, wherein said tip conditioning mechanism has a rotational axis located on a first radial line passing through the center of the spherical housing;

said motor having a rotational axis located on a second radial line passing through the center of the spherical housing.

6. The device of claim 5, wherein said first clutch element comprises a first transmission element; and said second clutch element comprises a second transmission element adapted to engage said first transmission element.

7. The device of claim 5, and further comprising a motor control switch means operated by movement of said conditioning mechanism to the clutch-engaged condition, whereby said motor is energized simultaneously with engagement of said clutch elements.

8. The device of claim 7, and further comprising a second tip conditioning mechanism radially mounted in said housing;

a third clutch element on said second conditioning mechanism;

second spring means biasing said second conditioning mechanism to a position wherein said third clutch element is disengaged from said first clutch element;

said second conditioning mechanism being deflectable by contact with a cue tip, whereby said first and third clutch elements are engaged for transmitting a rotary drive force from the motor to the second conditioning mechanism.

9. The device of claim 8, wherein said second tip conditioning mechanism has a rotational axis located on a third radial line from the center of the spherical housing.

10. The device of claim 9, wherein each clutch element comprises a bevel gear.

11. The device of claim 9, wherein said motor control switch means comprises an operator in the path of said second conditioning mechanism, whereby said motor is energized when said third clutch element is moving into engagement with said first clutch element.

12. A device for conditioning a cue tip, comprising:

a housing;

an electric motor with said housing;

said motor having a drive shaft located on a first axis and a first clutch element on said shaft;

a first tip conditioning mechanism rotatably mounted on a second axis acutely angled to said first axis;

a second clutch element on said first conditioning mechanism, first spring means biasing said first conditioning mechanism away from a position wherein said second clutch element is engaged with said first clutch element;

said first tip conditioning mechanism being deflectable to a clutch-engaged position by contact with a cue tip;

a second tip conditioning mechanism rotatably mounted on a third axis acutely angled to said first axis;

a third clutch element on said conditioning mechanism;

second spring means biasing said second conditioning mechanism away from a position wherein said third clutch element is engaged with said first clutch element;

said second conditioning mechanism being deflectable to a clutch-engaged position by contact with a cue tip.

13. The device of claim 12, and further comprising a motor control switch means operated by movement of any of said tip conditioning mechanisms to the clutch-engaged condition.

14. The device of claim 13, wherein said motor control switch means comprises a conductive disk on said first axis, a first conductive leaf moveable by said first clutch element into contact with said conductive disk; and a second conductive leaf movable by said second clutch element into contact with said conductive disk.

15. The device of claim 13, and further comprising a powder dispenser within said housing.

16. The device of claim 15, wherein said powder dispenser comprises a closure wall having a plurality of powder discharge openings, and a manually depressible valve means controlling powder flow through said openings.

17. The device of claim 15, wherein said housing is a hollow sphere split on a diametrical plane into two separable semi-spherical housing sections;

said motor and said tip conditioning mechanisms being located in one of said housing sections;

said powder dispenser being located in the other housing section.

18. The device of claim 17, wherein the motor drive shaft axis is located on a first radial line generated from the center of the spherical housing;

the rotational axis of said first conditioning mechanism being located on a second radial line generated from the center of the spherical housing;

the rotational axis of said second conditioning mechanism being located on a third radial line generated from the center of the spherical housing.

19. The device of claim 18, wherein each clutch element is a bevel gear.

* * * * *